US009281155B2

(12) United States Patent
Ueda et al.

(10) Patent No.: US 9,281,155 B2
(45) Date of Patent: Mar. 8, 2016

(54) RADIATION GENERATING APPARATUS AND RADIATION IMAGING APPARATUS

(75) Inventors: Kazuyuki Ueda, Tokyo (JP); Miki Tamura, Kawasaki (JP); Yasue Sato, Machida (JP); Takao Ogura, Yokohama (JP); Ichiro Nomura, Atsugi (JP); Shuji Aoki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 183 days.

(21) Appl. No.: 13/884,339

(22) PCT Filed: Nov. 8, 2011

(86) PCT No.: PCT/JP2011/076134

§ 371 (c)(1),
(2), (4) Date: May 9, 2013

(87) PCT Pub. No.: WO2012/077463

PCT Pub. Date: Jun. 14, 2012

(65) Prior Publication Data

US 2013/0230143 A1 Sep. 5, 2013

(30) Foreign Application Priority Data

Dec. 10, 2010 (JP) ..... 2010-275620

(51) Int. Cl.
*H01J 35/02* (2006.01)
*H01J 35/18* (2006.01)
(Continued)

(52) U.S. Cl.
CPC ..... *H01J 35/02* (2013.01); *H01J 35/18* (2013.01); *H05G 1/025* (2013.01); *H05G 1/04* (2013.01); *H01J 2235/1204* (2013.01); *H01J 2235/186* (2013.01)

(58) Field of Classification Search
CPC ..... H01J 2235/186; H01J 2235/087; H01J 35/02; H01J 35/12; H01J 35/16; H01J 35/18; H01J 35/105; H01J 2235/1024; H05G 1/02; H05G 1/025; H05G 1/04
USPC ..... 378/119, 121, 130, 141, 143
See application file for complete search history.

(56) References Cited

U.S. PATENT DOCUMENTS 2,098,315 A * 11/1937 Sharp ..... 378/141
3,867,637 A * 2/1975 Braun et al. ..... 378/2
(Continued)

FOREIGN PATENT DOCUMENTS

JP H07-057668 3/1995
JP H07-260713 A 10/1995
(Continued)

OTHER PUBLICATIONS

Office Action issued on Mar. 26, 2014, in counterpart EPA 11793511.4.
(Continued)

*Primary Examiner* — Anastasia Midkiff
(74) *Attorney, Agent, or Firm* — Fitzpatrick, Cella, Harper & Scinto

(57) ABSTRACT

A radiation generating apparatus has a radiation generating tube held in a holding container 12 and a cooling medium between the holding container and the radiation generating tube. The radiation generating tube includes an envelope with an aperture, an electron emitting source arranged in the envelope, a target arranged facing the source, for generating radiation responsive to irradiation with an electron beam emitted from the source, and a tubular shield for holding the target by an inner wall thereof and shielding part of the radiation emitted from the target. The shield is arranged to protrude outward of the envelope so that the target is positioned on an outer side of the aperture, and the cooling medium contacts at least a part of the shield.

16 Claims, 4 Drawing Sheets

(51) Int. Cl.

| | |
|---|---|
| ***H05G 1/02*** | (2006.01) |
| ***H05G 1/04*** | (2006.01) |

(56) References Cited

U.S. PATENT DOCUMENTS

| | | | | |
|---|---|---|---|---|
| 4,400,824 | A * | 8/1983 | Shidara | 378/141 |
| 4,455,504 | A * | 6/1984 | Iversen | 313/30 |
| 5,629,969 | A | 5/1997 | Koshishiba | 378/138 |
| 8,139,716 | B2 | 3/2012 | Okunuki et al. | 378/122 |
| 8,472,585 | B2 | 6/2013 | Ogura et al. | |
| 2003/0021377 | A1 | 1/2003 | Turner et al. | 378/102 |
| 2004/0076260 | A1* | 4/2004 | Charles, Jr. et al. | 378/124 |
| 2007/0025516 | A1* | 2/2007 | Bard et al. | 378/138 |
| 2008/0089484 | A1* | 4/2008 | Reinhold | 378/138 |
| 2008/0232546 | A1* | 9/2008 | Stierstorfer | 378/70 |
| 2009/0086898 | A1* | 4/2009 | Richardson et al. | 378/45 |
| 2012/0307974 | A1 | 12/2012 | Yamazaki et al. | |
| 2012/0307978 | A1 | 12/2012 | Yamazaki et al. | |
| 2013/0016810 | A1 | 1/2013 | Tamura et al. | |
| 2013/0016811 | A1 | 1/2013 | Ueda et al. | |
| 2013/0016812 | A1 | 1/2013 | Yanagisawa et al. | |
| 2013/0034207 | A1 | 2/2013 | Aoki et al. | |
| 2013/0148781 | A1 | 6/2013 | Yamazaki et al. | |

FOREIGN PATENT DOCUMENTS

| | | | |
|---|---|---|---|
| JP | H07-260713 | A | 10/1995 |
| JP | 2002-343290 | A | 11/2002 |
| JP | 2005-523558 | A | 8/2005 |
| JP | 2007-265981 | | 10/2007 |
| WO | WO 2006/105332 | | 10/2006 |

OTHER PUBLICATIONS

C. Jensen et al., "Improvements in Low Power, End-Window, Transmission-Target X-Ray Tubes", *Advances in X-Ray Analysis*, vol. 47, pp. 64-69 (2004).

Office Action issued on Apr. 28, 2014 in counterpart Korean application 10-2013-7016456, with translation (see above).

Office Action issued in Japanese Patent Application 2010-275620 on Sep. 24, 2013, with partial translation.

Office Action issued on Feb. 28, 2015 in counterpart Chinese application 201180058649.3, with translation.

* cited by examiner

RADIATION GENERATING APPARATUS AND RADIATION IMAGING APPARATUS

TECHNICAL FIELD

The present invention relates to a radiation generating apparatus including a holding container that is charged with a cooling medium and houses therein a transmission type radiation generating tube using an electron emitting source, and a radiation imaging apparatus including such radiation generating apparatus.

BACKGROUND ART

In general, a radiation generating tube accelerates electrons emitted from an electron emitting source to high energies and irradiates a target including a metal, such as tungsten, with the high energies to generate radiations such as X-rays. The generated radiations are emitted in all directions. Therefore, in order to shield unnecessary radiations, a container is provided to house the radiation generating tube or the radiation generating tube is surrounded by a shield (radiation shielding member) such as one including lead to prevent external leakage of the unnecessary radiations. Thus, such radiation generating tube and such radiation generating apparatus that houses the radiation generating tube therein have a difficulty in size and weight reduction.

As a solution for this problem, Japanese Patent Application Laid-Open No. 2007-265981 discloses a method in which a shield is arranged on each of the radiation emission side and the electron entrance side of a target in a transmission type radiation generating tube to shield unnecessary radiations with a simple structure as well as providing reduction in size and weight of the apparatus.

However, in general, in such transmission type radiation generating tube to which a target, i.e., an anode is fixed, the target does not necessarily sufficiently radiates heat because of the effect of local heat generated in the target, resulting in difficulty in generation of high-energy radiation. Regarding the target's heat radiation, PTL 1 describes that the transmission type radiation generating tube described therein has a structure in which a target and a shield are joined to each other, thereby heat generated in the target being radiated as a result of being transferred to the shield, enabling suppression of an increase in temperature of the target.

CITATION LIST

Patent Literature

PTL 1: Japanese Patent Application Laid-Open No. 2007-265981

SUMMARY OF INVENTION

Technical Problem

However, in the transmission type radiation generating tube disclosed in PTL 1, the shield is arranged in a vacuum container, limiting a region of heat transfer from the shield to the outside of the vacuum container. Thus, the target does not necessarily sufficiently radiate heat, and therefore, there is a problem in providing both the capability of cooling the target and reduction in size and weight of the apparatus.

Therefore, an object of the present invention to provide a radiation generating apparatus capable of shielding unnecessary radiations and cooling a target with a simple structure as well as enabling size and weight reduction, and a radiation imaging apparatus including the same.

Solution to Problem

In order to achieve the object, a radiation generating apparatus according to the present invention comprises: radiation generating apparatus comprising: a radiation generating tube; a holding container for holding inside thereof the radiation generating tube; and a cooling medium positioned between the holding container and the radiation generating tube, wherein the radiation generating tube has an envelope having an aperture, an electron emitting source arranged in the envelope, a target arranged in opposition to the electron emitting source, for generating a radiation responsive to an irradiation with an electron beam emitted from the electron source, and a shield member with tubular shape, for holding the target within an inner wall of the shield member, and for shielding a part of the radiation emitted from the target, the shield member protrudes toward an outside of the envelope so that the target is held at an outer side of the envelope beyond the aperture, and the cooling medium contacts at least a part of the shield member.

Advantageous Effects of Invention

The present invention can provide a structure in which a large area is provided for radiating heat to the cooling medium 33 and a part having a highest temperature serves as a heat radiation surface. Consequently, heat of the target is transferred to the cooling medium 33 through the transmitting substrate and the shield, and thus, the beneficial advantageous effect of providing a radiation generating apparatus using a highly-reliable transmission type radiation generating tube that can suppress an increase in temperature of the transmitting substrate for enabling long-time driving for radiation generation is provided.

Further features of the present invention will become apparent from the following description of exemplary embodiments with reference to the attached drawings.

DESCRIPTION OF EMBODIMENTS

Figure 1:
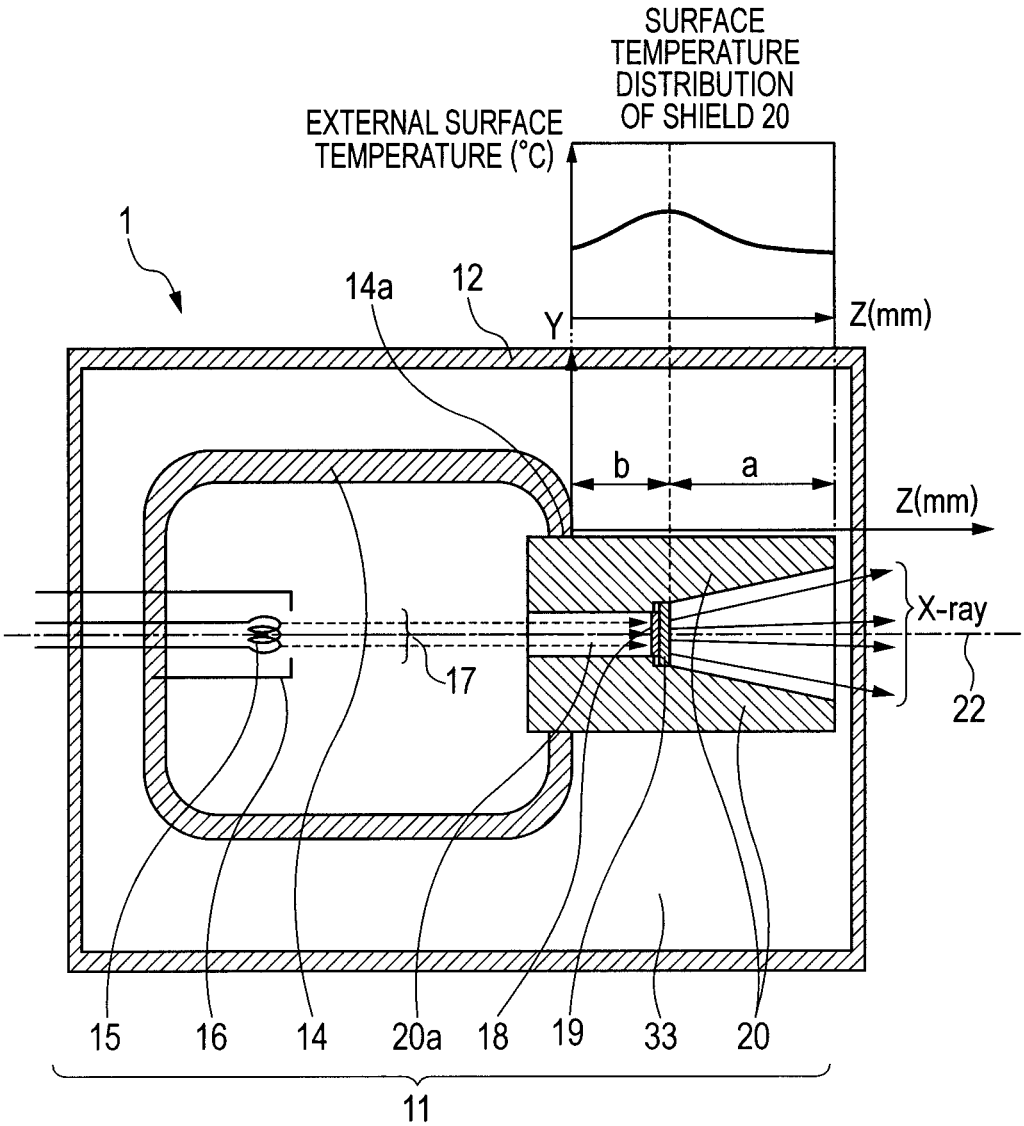
FIG. 1 illustrates a schematic cross-sectional diagram of a radiation generating apparatus using a transmission type radiation generating tube according to a first embodiment, and a temperature distribution diagram at an external surface of a shield.

Hereinafter, embodiments of the present invention will be described with reference to the drawings; however, the present invention is not limited to these embodiments. Techniques known in the art or publicly known are applied to parts neither specifically illustrated in the drawings nor described in the specification.

First Embodiment

First, a radiation generating apparatus according to a first embodiment of the present invention will be described with reference to FIG. 1. FIG. 1 illustrates a schematic cross-sectional diagram of a radiation generating apparatus using a transmission type radiation generating tube according to the present embodiment, and a temperature distribution diagram at an external surface of a shield. The schematic cross-sectional diagram in FIG. 1 indicates a Z-Y cross-section with a direction of a center line of an electron flux (electron flux center line 22) as a Z-axis direction.

As illustrated in FIG. 1, a radiation generating apparatus 1 according to the present embodiment includes a transmission type radiation generating tube 11, and the transmission type radiation generating tube 11 is housed inside a holding container 12. The rest of the space inside the holding container 12 except the space in which the transmission type radiation generating tube 11 is housed is charged with a cooling medium 33.

The holding container 12 is a metal container defined by metals plates to form a box shape. The metal included in the holding container 12 has electric conductivity, and may be, e.g., iron, stainless steel, lead, brass or copper, and provides a structure that can support the weight of the container. A part of the holding container 12 is provided with a non-illustrated inlet for injecting the cooling medium 33 into the holding container 12. Since the temperature of the cooling medium 33 increases when the transmission type radiation generating tube 11 is driven, a non-illustrated pressure adjustment port using an elastic member may be provided at a part of the holding container 12 as necessary in order to avoid an increase in internal pressure of the holding container 12 when the cooling medium 33 expands.

The cooling medium 33 may be any liquid having an electrical insulating property, and desirably causing less alteration by heat and having a high cooling capability and a low viscosity, and for example, may be an electrical insulating oil such as a silicone oil or a fluorine series oil, or a fluorine series inactive liquid.

The transmission type radiation generating tube 11 includes a cylindrical envelope 14 including a circular aperture portion 14*a*, an electron emitting source 15, a control electrode 16, a transmitting substrate 19, a target 18 and a shield 20.

The envelope 14 includes a high electrical insulating material having a high heat resistance as well as capability of maintaining a high vacuum. Here, the high electrical insulating material may be, for example, alumina or heat resistance glass. As described later, the inside of the envelope 14 is maintained at a predetermined degree of vacuum.

Inside the envelope 14, the electron emitting source 15 is arranged so as to face the aperture portion 14*a* of the envelope 14. Although the electron emitting source 15 in the present embodiment is, for example, a filament, the electron emitting source 15 may be another electron emitting source such as an impregnation-type cathode or a field emission-type component. In general, in order to maintain a degree of vacuum equal to or lower than $1\times10^{-4}$ Pa, which enables driving of the electron emitting source 15, a non-illustrated getter, NEG or small ion pump for absorbing a gas emitted in driving the transmission type radiation generating tube 11 is mounted inside the envelope 14.

A control electrode 16 is arranged around the electron emitting source 15. Thermal electrons emitted from the electron emitting source 15 form an electron flux 17, which includes electrons accelerated toward the target 18, by means of a potential of the control electrode 16. On/off control of the electron flux 17 is performed by control of a voltage of the control electrode 16. The control electrode 16 includes a material such as, for example, stainless steel, molybdenum or iron. The target 18 has a positive potential relative to the electron emitting source 15, and thus, the electron flux 17 is attracted to and collides with the target 18, resulting in generation of radiations. The radiation generating apparatus 1 according to the present embodiment is configured as an X-ray generating apparatus in which the target 18 is irradiated with the electron flux 17 to generate X-rays as radiations.

It should be noted that a lens electrode can be provided ahead of the control electrode 16 in a direction of the electron irradiation for a diameter of the electron flux to be further converged.

In the aperture portion 14*a* of the envelope 14, a shield 20 is provided so as to protrude toward the outside of the envelope 14, a portion of joint between the envelope 14 and the shield 20 has a sealed structure. The shield 20 has a cylindrical shape, and a passage 20*a* that communicates with the aperture portion 14*a* of the envelope 14. The shield 20 may include a metal having a high X-ray absorbing capability such as tungsten, molybdenum, oxygen-free copper or lead.

A transmitting substrate 19 that transmits radiations is provided at a position in the passage 20*a* in the shield 20. The target 18 is arranged on a surface on the electron emitting source side of the transmitting substrate 19. The transmitting substrate 19 has a function that absorbs X-rays in unwanted directions, which are emitted from the target 18, and a function as a plate for diffusing heat of the target 18. The transmitting substrate 19 includes a material that is high in heat conductivity and low in X-ray attenuation quantity and has a plate-like shape, and, e.g., SiC, diamond, or thin-film oxygen-free copper is suitable for the material. The transmitting substrate 19 is joined to the passage 20*a* of the shield 20 by means of, e.g., silver brazing. An arrangement of the transmitting substrate 19 in the passage 20*a* of the shield 20 will be described later.

When generating X-rays, for example, tungsten, molybdenum, copper or gold is used for the target 18. The target 18 includes a metal thin film, and is provided on the surface on the electron emitting source side of the transmitting substrate 19. When an X-ray radiograph of a human body is taken, the target 18 has a potential around +30 to 150 KV higher than a potential of the electron emitting source 15. Such potential difference is an accelerating potential difference necessary for the X-rays emitted from the target 18 to penetrate the human body to effectively contribute to the radiography.

When tungsten is used, the target 18 has a film thickness of, for example, from around 3 to 15 μm. In the case of a film thickness of 3 μm, a predetermined X-ray generation amount can be obtained by applying a voltage making the potential of the electrons of the target 18 be +30 KV higher than the potential of the electron emitting source 15. Also, in the case of a film thickness of 15 μm, a predetermined X-ray generation amount can be obtained by applying a voltage making the potential of the target 18 be around +150 KV higher than the potential of the electron emitting source 15.

In the passage 20*a* of the shield 20, the transmitting substrate 19 is arranged at a position on the outer side relative to an external wall surface of the envelope 14. A part of the passage 20*a* of the shield 20 up to a position where the transmitting substrate 19 is arranged is a cylindrical hole, while a part of the passage 20*a* on the side of the transmitting substrate 19 opposite to the electron emitting source has a shape with a gradually increasing an internal diameter. In the present embodiment, the transmitting substrate 19 and the target 18 provided in the passage 20*a* of the shield 20 are arranged at a position on the outer side relative to the external wall surface of the envelope 14 in their entireties.

Since the transmitting substrate 19 is joined to a position in the passage 20*a* of the shield 20, and thus, the vacuum on the envelope 14 side relative to the transmitting substrate 19 is maintained. Furthermore, the cooling medium 33 charged inside the holding container 12 enters a part of the passage 20*a* of the shield 20 on the outer side relative to the transmitting substrate and contacts the transmitting substrate 19.

In other words, in the present embodiment, the cooling medium 33 contacts the transmitting substrate 19, a major part of an external surface of the shield 20 and an internal surface of the passage 20*a* on the outer side relative to the transmitting substrate. Since the transmitting substrate 19 is joined to the passage 20*a* of the shield 20, and thus, when X-rays are generated as a result of the electron flux 17 colliding with the target 18, heat generated in the target 18 is transferred to the cooling medium 33 through the transmitting substrate 19 and the shield 20.

For achieving the aforementioned heat transfer, it is only necessary that at least a part of the transmitting substrate 19 be arranged at a position on the outer side relative to the external wall surface of the envelope 14. Furthermore, the target-mounting surface of the transmitting substrate 19 has a high temperature because of the contact with the target 18, and thus, the target-mounting surface can be positioned on the outer side relative to the external wall surface of the envelope 14. Furthermore, it is only necessary that the cooling medium 33 contact at least a part of the shield 20.

Next, an operation when the radiation generating apparatus 1 according to the present embodiment is driven will be described with reference to the temperature distribution diagram in the upper part of FIG. 1. When the transmission type radiation generating tube 11 in the radiation generating apparatus 1 according to the present embodiment is driven, a temperature distribution occurs on the external surface of the shield 20. As illustrated in the temperature distribution diagram in FIG. 1, a temperature distribution exhibiting a substantially symmetrical protruding shape (mound shape) with the position of the transmitting substrate 19 as a center thereof in the Z-axis direction occurs. As an example, when the transmission type radiation generating tube 11 is driven with an output of around 150 W, the external surface of the shield 20 can be presumed to have a highest temperature of 200° C. or higher.

A case where the transmitting substrate 19 is arranged at a position on the outer side relative to the external wall surface of the envelope 14 like in the present embodiment, and a case where the transmitting substrate 19 is arranged inside the external wall surface of the envelope 14 will be compared. Since the target 18 is mounted on the surface on the electron emitting source side of the transmitting substrate 19, a part on the electron emitting source side relative to the transmitting substrate 19 has a high temperature. Accordingly, according to the present embodiment, the high-temperature part on the electron emitting source side relative to the transmitting substrate 19 contacts the cooling medium 33 via the shield 20, and thus, the area for radiating heat to the cooling medium 33 is large relative to the case where the transmitting substrate 19 is arranged inside the envelope 14.

More specifically, for the shield 20 in FIG. 1, it is assumed that the length from an external surface of the transmitting substrate 19 to an extremity of the shield 20 is a (mm) and the length from the external surface of the transmitting substrate 19 to the external wall of the envelope 14 is b (mm). An increase in the amount of heat radiation from the shield 20 to the cooling medium 33, which corresponds to the amount of the increase in the area where the shield 20 contacts the cooling medium 33, is made compared to the case where the transmitting substrate 19 is arranged inside the external wall surface of the envelope 14. Accordingly, the shield 20's cooling capability is increased around (a+b)/a times, enabling suppression of an increase in temperature of the target 18 and the transmitting substrate 19.

As described above, the radiation generating apparatus 1 according to the present embodiment can provide a structure in which a large area is provided for radiating heat to the cooling medium 33 and a part having a highest temperature serves as a heat radiation surface, and thus, can provide a structure with a high heat radiation capability.

Accordingly, an increase in temperature of the target 18 and the transmitting substrate 19 per unit time during the transmission type radiation generating tube 11 being driven becomes smaller, and thus, it takes longer time for the target 18 and the transmitting substrate 19 to reach their respective upper temperature limits during the driving. Consequently, a radiation generating apparatus 1 using a highly-reliable transmission type radiation generating tube 11 enabling long-time driving for X-ray generation can be provided.

Second Embodiment

Figure 2:
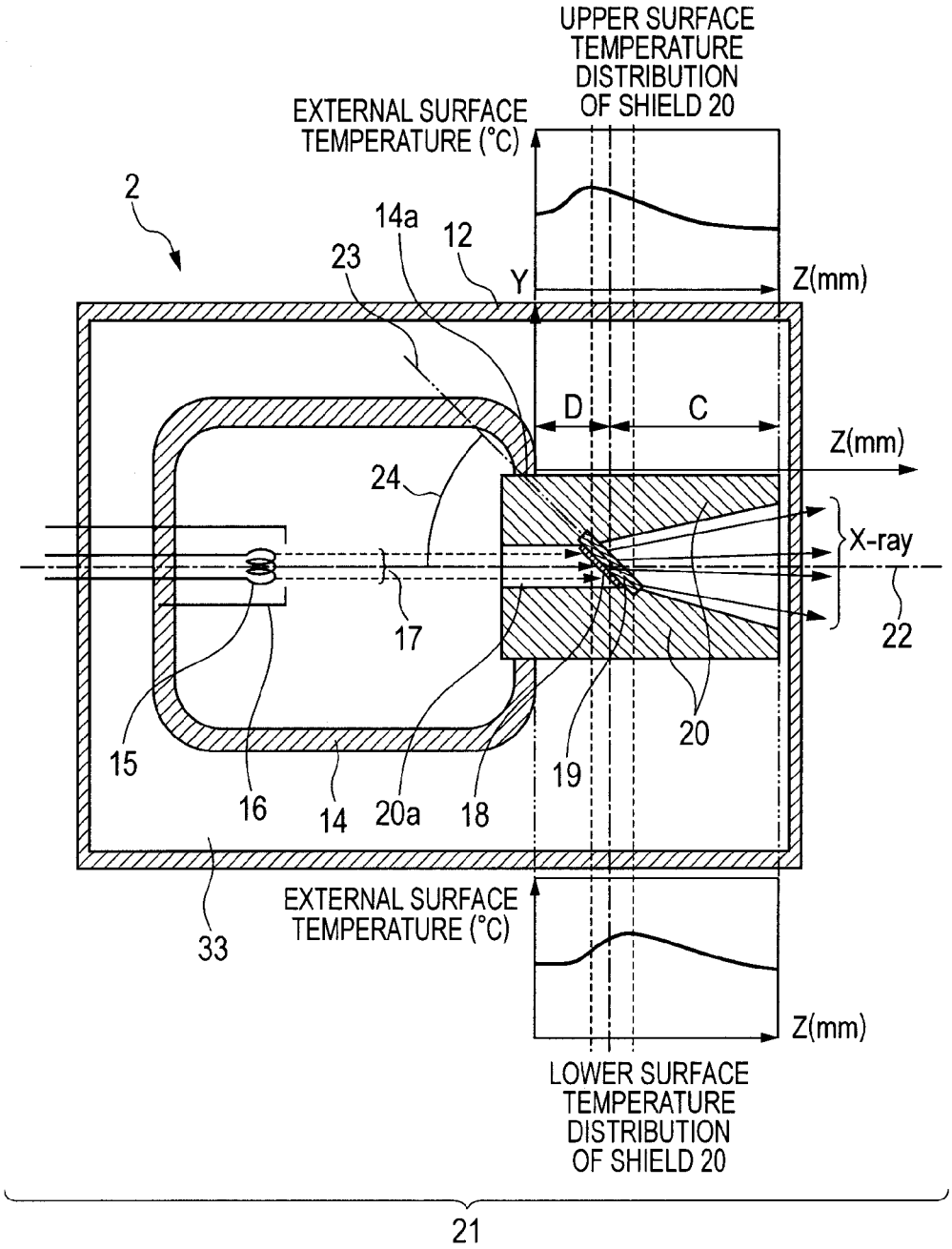
FIG. 2 illustrates a schematic cross-sectional diagram of a radiation generating apparatus using a transmission type radiation generating tube according to a second embodiment, and a temperature distribution diagram at an external surface of a shield.

Next, a radiation generating apparatus according to a second embodiment of the present invention will be described with reference to FIG. 2. FIG. 2 illustrates a schematic cross-sectional diagram of a radiation generating apparatus using a transmission type radiation generating tube according to the present embodiment, and a temperature distribution diagram at an external surface of a shield. For a description of components that are the same as those of the radiation generating apparatus 1 according to the first embodiment, reference numerals that are the same as those of the first embodiment are used.

As illustrated in FIG. 2, a radiation generating apparatus 2 according to the present embodiment is different from the first embodiment in that a transmitting substrate 19 is arranged on a plane not perpendicular to, but inclined with regard to a passage 20*a* of a shield 20. More specifically, a substrate inclination angle 24 corresponding to an angle formed by an electron flux center line 22, which is a center line of an electron flux 17, and a target-mounting surface of the transmitting substrate 19 (substrate surface direction 23, which is an extension of an internal surface of the transmitting substrate 19) is less than 90 degrees, and preferably, in the range of no less than 8 degrees to less than 90 degrees. If the inclination angle is less than 8 degrees, the length of the transmitting substrate 19 is large, which is impractical for a transmission type radiation generating tube 21. In the case where the target substrate 19 is joined at an angle to the shield 20, a surface of the joint has an oval ring shape, increasing the area of the joint, and thus, increasing the amount of heat transfer from the target substrate 19 to the shield plate 20.

Next, an operation when the radiation generating apparatus 2 according to the present embodiment is driven will be described with reference to the temperature distribution diagram in the upper part of FIG. 2. When the transmission type radiation generating tube 21 in the radiation generating apparatus 2 according to the present embodiment is driven, a temperature distribution with a protruding shape (mound shape) with a position of the transmitting substrate 19 as a center thereof occurs on an external surface of the shield 20 in a Z-axis direction. Since the transmitting substrate 19 is joined at an angle to the passage 20*a* of the shield 20, an apex portion of the temperature distribution having a protruding shape with the position of the transmitting substrate 19 as a center thereof extends in an oval shape in a circumference direction of the shield 20.

In the example in FIG. 2, the temperature distribution of the external surface of the shield 20 exhibits that an upper portion of the surface and a lower portion of the surface are different from each other in highest temperature position in the Z-axis direction. Here, it is assumed that a distance from an intersection between the electron flux center line 22 and the target-mounting surface of the transmitting substrate 19 to an extremity of the shield is C (mm) and a distance from the intersection between the electron flux center line 22 and the target-mounting surface of the transmitting substrate 19 to the external surface of the envelope 14 is D (mm). Considering the temperature distribution of the entire circumference of the shield 20, the effect of an increase in the amount of heat radiation to the cooling medium 33, which substantially corresponds to an increase in the area where the shield 20 contacts the cooling medium 33, is provided compared to a case where the transmitting substrate 19 is arranged inside the envelope 14. Accordingly, the shield 20's cooling capability is increased by approximately (C+D)/C, enabling further suppression of an increase in temperature of the target 18 and the transmitting substrate 19 during X-ray generation.

As described above, the radiation generating apparatus 2 according to the present embodiment basically provides operations and effects similar to those of the first embodiment. In particular, in the radiation generating apparatus 2 according to the present embodiment, the transmitting substrate 19 is inclined, increasing the area where the transmitting substrate 19 contacts the cooling medium 33, and thus, increasing the amount of heat radiated by the transmitting substrate 19 to the cooling medium 33. Accordingly, the increase in temperature of the target 18 and the transmitting substrate 19 can further be suppressed.

Third Embodiment

Figure 3:
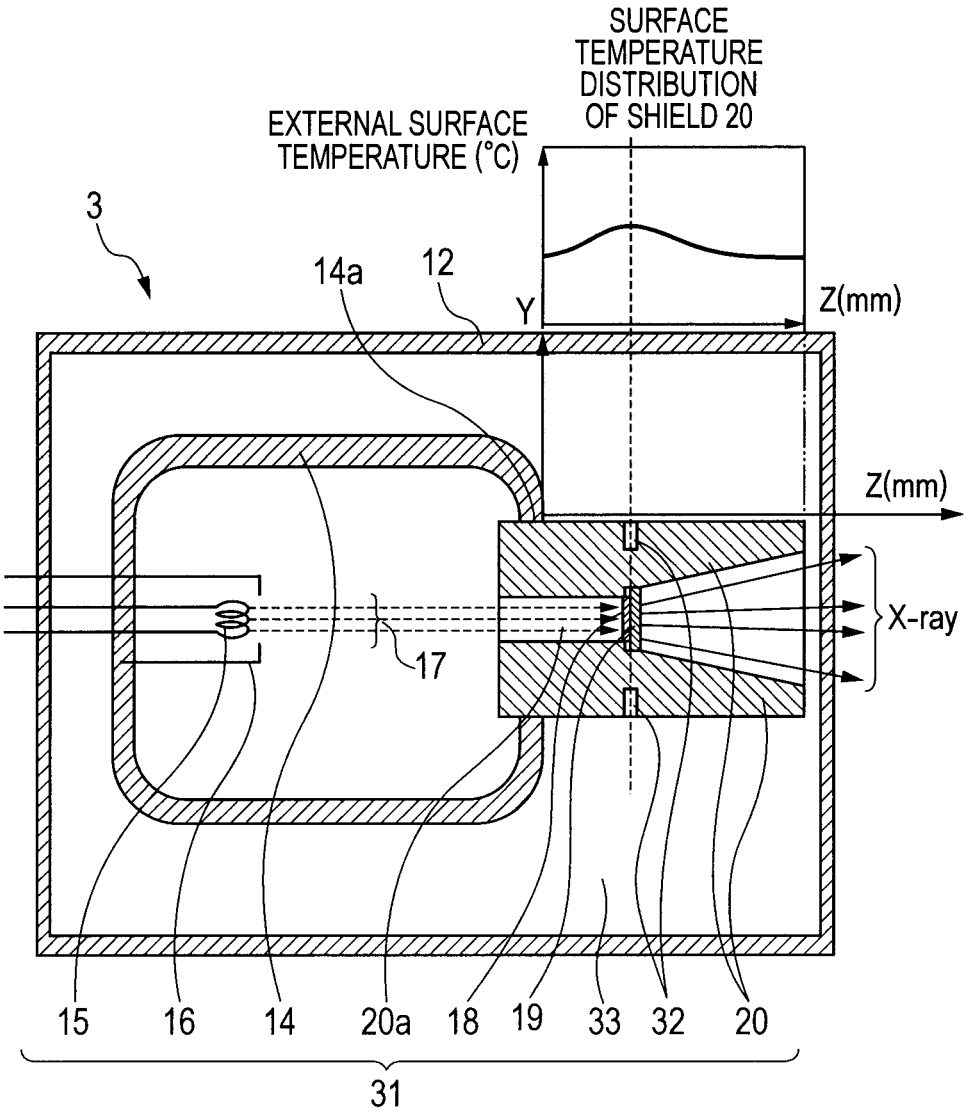
FIG. 3 illustrates a schematic cross-sectional diagram of a radiation generating apparatus using a transmission type radiation generating tube according to a third embodiment, and a temperature distribution diagram at an external surface of a shield.

Next, a third embodiment of a radiation generating apparatus according to the present invention will be described with reference to FIG. 3. FIG. 3 illustrates a schematic cross-sectional diagram of a radiation generating apparatus using a transmission type radiation generating tube according to the present embodiment, and a temperature distribution diagram at an external surface of a shield. The description will be provided using reference numerals that are the same as those of the radiation generating apparatus 1 according to the first embodiment for components that are the same as those of the first embodiment.

As illustrated in FIG. 3, the radiation generating apparatus 3 according to the present embodiment is different from the first embodiment in that a cooling medium guiding portion 32 for guiding a cooling medium 33 into a shield 20 is provided. The cooling medium guiding portion 32 can be arranged at a position on the electron emitting source side relative to the transmitting substrate 19 so that the cooling medium 33 contacts a high temperature part of the shield 20. More specifically, a groove-like cooling medium guiding portion 32 is formed at a position around the entire circumference of an external surface of the shield 20 where the external surface temperature is the highest, in the vicinity of a plane that is the same as that of the transmitting substrate 19. A part of the shield 20 between a bottom portion of the cooling medium guiding portion 32 and the transmitting substrate 19 can be set to have a thickness of 2 mm or more. This is because such thickness is a lower limit thickness proper for X-rays generated in a target 18 and emitted in all directions to be shielded by the shield 20 to prevent operation staff for the radiation generating apparatus 3 from being exposed to radiation. If the thickness is less than 2 mm, it may be necessary to provide a structure having an X-ray shielding function outside the holding container 12.

Next, an operation when the radiation generating apparatus 3 according to the present embodiment is driven will be described with reference to the temperature distribution diagram in the upper part of FIG. 3. When the transmission type radiation generating tube 31 in the radiation generating apparatus 3 according to the present embodiment is driven, a temperature distribution having a substantially symmetrical protruding shape (mound shape) with a position of the transmitting substrate 19 as a center thereof occurs at the external surface of the shield 20 in a Z-axis direction. In the case where the transmission type radiation generating tube 31 is driven with power of around 150 W as an example, it can be presumed that the highest temperature of the external surface of the shield 20 is 200° C. or higher. As described above, in the case where the transmitting substrate 19 is arranged at a position on the outer side relative to an external wall of the envelope 14, a high-temperature part on the electron emitting source side relative to the transmitting substrate 19 contacts the cooling medium 33, and the area for heat radiation can be increased, compared to a case where the transmitting substrate 19 is arranged inside the envelope 14. Consequently, an increase in temperature of the target 18 and the transmitting substrate 19 during X-ray generation can further be suppressed.

As described above, the radiation generating apparatus 3 according to the present embodiment basically provides operations and effects similar to those of the first embodiment. In particular, in the radiation generating apparatus 3 according to the present embodiment, a groove-like cooling medium guiding portion 32 is formed at the external surface of the shield 20, allowing the cooling medium 33 to enter the cooling medium guiding portion 32, and thus, increasing the area of contact between the cooling medium 33 and the shield 20. Consequently, an increase in temperature of the target 18 and the transmitting substrate 19 can further be suppressed.

Fourth Embodiment

Figure 4:
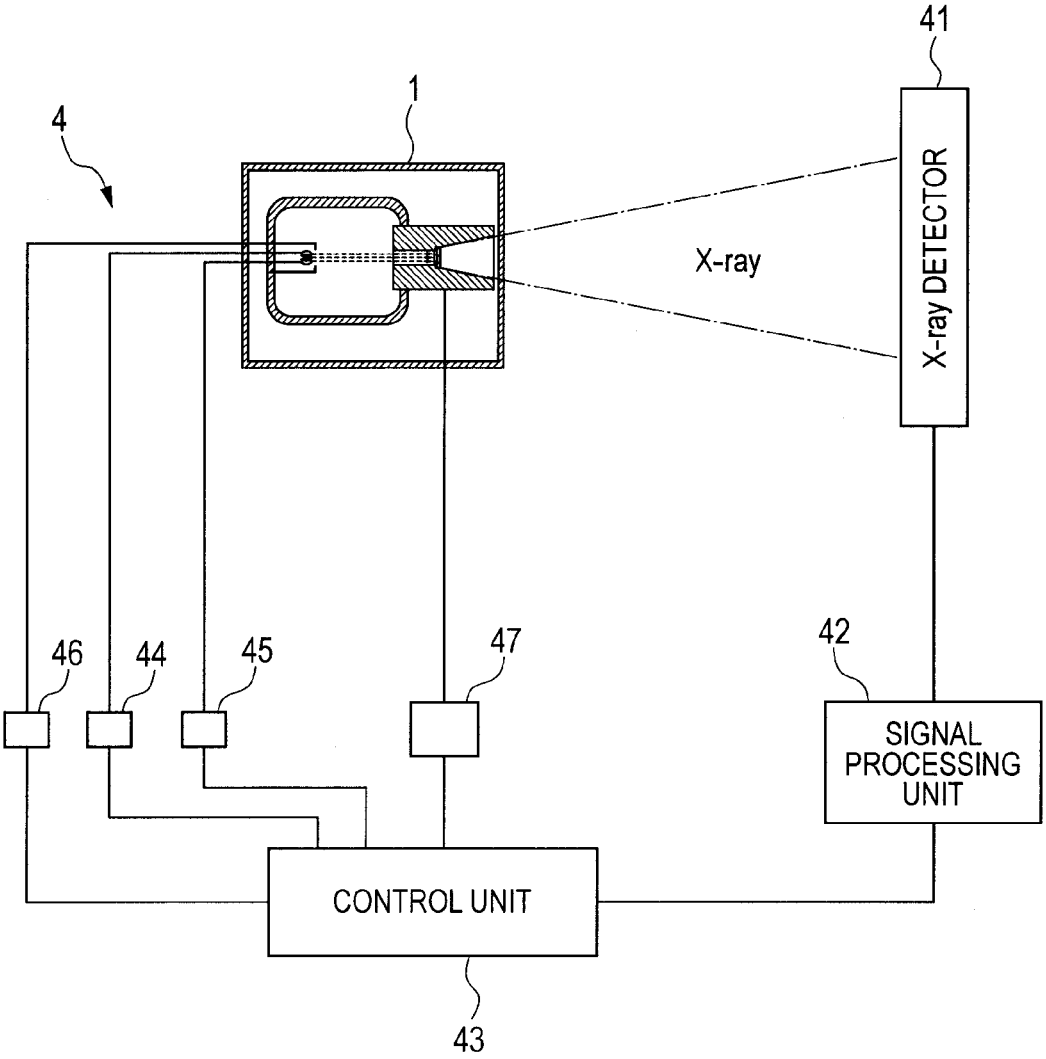
FIG. 4 is a schematic diagram of a radiation imaging apparatus according to a fourth embodiment.

Next, a radiation imaging apparatus according to a fourth embodiment using a radiation generating apparatus described above will be described with reference to FIG. 4. FIG. 4 is a schematic diagram illustrating a radiation imaging apparatus according to the present embodiment. Here, the radiation generating apparatus 1 in FIG. 1 is used; however, an X-ray imaging apparatus can be provided using the radiation generating apparatus 2 in FIG. 2 or the radiation generating apparatus 3 in FIG. 3. Accordingly, in FIG. 4, only reference numerals for the radiation generating apparatus 1 according to the first embodiment are provided.

As illustrated in FIG. 4, a radiation imaging apparatus 4 according to the present embodiment is configured so that a radiation detecting unit (X-ray detector) 41 is arranged ahead in a direction of X-ray emission of a transmission type radiation generating tube 11 via a non-illustrated object.

The X-ray detector 41 is connected to an X-ray imaging apparatus control unit 43 via a signal processing unit (X-ray detection signal processing unit) 42. Output signals from the X-ray imaging apparatus control unit 43 are connected to respective terminals on the electron emitting source side of the transmission type radiation generating tube 11 via an electron emitting source drive unit 44, an electron emitting source heater control unit 45 and a control electrode voltage control unit 46. Also, an output signal from the X-ray imaging apparatus control unit 43 is connected to a terminal of a target 18 in the transmission type radiation generating tube 11 via a target voltage control unit 47.

Upon generation of X-rays in the transmission type radiation generating tube 11 in the radiation generating apparatus 1, radiations in the X-rays emitted to the air that has penetrated an object is detected by the radiation detecting unit 41, and the signal processing unit 42 forms a radiographic image (X-ray radiographic image) from the result of detection by the radiation detecting unit 41.

The radiation imaging apparatus 4 according to the present embodiment uses the radiation generating apparatus 1 using the highly-reliable transmission type radiation generating tube 11 enabling long-time driving for X-ray generation, and thus, a highly-reliable X-ray imaging apparatus enabling long-time driving for X-ray generation can be provided.

Although exemplary embodiments of the present invention have been described above, these embodiments are mere examples for describing the present invention, and the present invention can be carried out in various modes different from the embodiments as long as such modes do not depart from the scope and spirit of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-275620, filed Dec. 10, 2010, which is hereby incorporated by reference herein in its entirety.

The invention claimed is:

1. An X-ray radiation generating apparatus comprising:
an X-ray radiation generating tube having
an envelope having an aperture,
an electron emitting source arranged in said envelope,
a target arranged in opposition to said electron emitting source and generating X-ray radiation responsive to an irradiation with an electron beam emitted from said electron emitting source, and
a tubular shield member shielding a part of the X-ray radiation emitted from said target and including an inner wall defining an electron beam pass; and
a holding container holding said X-ray radiation generating tube inside said holding container,
wherein said tubular shield member is provided in said aperture so as to protrude toward an outside of said envelope so that said target is held at an outer side of said envelope beyond said aperture, and
wherein said target is held at said inner wall of said tubular shield member such that said target and said inner wall of said tubular shield member meet at an angle that is not a right angle.

2. The X-ray radiation generating apparatus according to claim 1, wherein said target has a target thin film arranged in a side so as to face said electron emitting source, and has a supporting substrate arranged at an opposite side of said target thin film, for supporting said target thin film.

3. The X-ray radiation generating apparatus according to claim 2, wherein said supporting substrate is formed from diamond.

4. The X-ray radiation generating apparatus according to claim 1, wherein said target is arranged with a normal axis of said target inclined at an angle with regard to a direction of the electron irradiation.

5. The X-ray radiation generating apparatus according to claim 1, further comprising:
a cooling medium positioned between said holding container and said X-ray radiation generating tube,
wherein said cooling medium contacts at least a part of a protruding portion of said tubular shield member.

6. The X-ray radiation generating apparatus according to claim 5, wherein said cooling medium is an electric insulating oil or a fluorochemical inactive liquid.

7. The X-ray radiation generating apparatus according to claim 6, wherein said cooling medium is an electric insulating oil, and said electric insulating oil is a silicone oil or a fluorochemical oil.

8. An X-ray radiation imaging apparatus comprising:
an X-ray radiation generating apparatus according to claim 1;
an X-ray radiation detecting unit for detecting X-ray radiation generated by said X-ray radiation generating apparatus and transmitted through an object; and
a signal processing unit for forming a transmitted-radiation image based on a result of detection by said X-ray radiation detecting unit.

9. An X-ray radiation generating apparatus comprising:
an X-ray radiation generating tube having
an envelope having an aperture,
an electron emitting source arranged in said envelope,
a target arranged in opposition to said electron emitting source and generating X-ray radiation responsive to an irradiation with an electron beam emitted from said electron emitting source, and
a tubular shield member shielding a part of the X-ray radiation emitted from said target and including said inner wall defining an electron beam pass; and
a holding container holding said X-ray radiation generating tube inside said holding container,
wherein said tubular shield member is provided in said aperture so as to protrude toward an outside of said envelope so that said target is held at an outer side of said envelope beyond said aperture, and
said target is held on said inner wall of said shield member inclined at an angle to said inner wall of said shield member such that an area over which said target and said inner wall are in contact is larger than would be the case if said target were at a right angle to said inner wall.

10. The X-ray radiation generating apparatus according to claim 9, further comprising:
a cooling medium positioned between said holding container and said X-ray radiation generating tube,
wherein said cooling medium contacts at least a part of a protruding portion of said tubular shield member.

11. The X-ray radiation generating apparatus according to claim 9, wherein said target has a target thin film arranged facing said electron emitting source, and has a supporting substrate arranged at a side opposite to said target thin film, for supporting said target thin film.

12. The X-ray radiation generating apparatus according to claim 11, wherein said supporting substrate is formed from diamond.

13. The X-ray radiation generating apparatus according to claim 9, wherein said target is arranged with its normal axis inclined at an angle relative to a direction of propagation of the electron irradiation.

14. The X-ray radiation generating apparatus according to claim 9, wherein said cooling medium is an electric insulating oil or a fluorochemical inactive liquid.

15. The X-ray radiation generating apparatus according to claim 14, wherein said electric insulating oil is a silicone oil or a fluorochemical oil.

16. An X-ray radiation imaging apparatus comprising:

an X-ray radiation generating apparatus according to claim 9;

an X-ray radiation detecting unit for detecting X-ray radiation generated by said X-ray radiation generating apparatus and transmitted through an object; and a signal processing unit for forming an X-ray radiation transmitting image based on a result of detection by said X-ray radiation detecting unit.

* * * * *